United States Patent [19]

Portz et al.

[11] 4,149,747

[45] Apr. 17, 1979

[54] GRAPPLER SPREADER FOR CLOSELY STACKING CARGO CONTAINERS

[75] Inventors: Woodrow W. Portz, Solon, Ohio; Jack E. Fathauer, Roxboro, N.C.

[73] Assignee: RPC Corporation, Roxboro, N.C.

[21] Appl. No.: 563,794

[22] Filed: Mar. 31, 1975

[51] Int. Cl.[2] ..... B66C 1/66; B66F 9/18

[52] U.S. Cl. ..... 294/81 SF; 414/608; 294/67 BC

[58] Field of Search ..... 294/67 R, 67 BB, 67 BC, 294/67 DA, 67 DB, 81 R, 81 SF; 214/396, 620, 621, 730

[56] References Cited

U.S. PATENT DOCUMENTS

| | | | |
|---|---|---|---|
| 3,458,229 | 7/1969 | Nagy et al. | 294/81 SF |
| 3,513,997 | 5/1970 | Heyer et al. | 294/67 R X |
| 3,558,172 | 1/1971 | Lamer et al. | 294/67 R |
| 3,558,176 | 1/1971 | Fathauer et al. | 294/81 SF X |
| 3,576,269 | 4/1971 | Shaffer | 294/67 R X |
| 3,589,540 | 6/1971 | Kinross | 294/67 R X |
| 3,602,375 | 8/1971 | Martinson | 212/14 |
| 3,606,053 | 9/1971 | Whiteman | 294/81 SF X |
| 3,633,777 | 1/1972 | Shelling et al. | 214/621 |
| 3,863,970 | 2/1975 | Gottlieb et al. | 294/81 SF X |
| 3,880,456 | 4/1975 | De Roshia | 294/81 SF |

*Primary Examiner*—Johnny D. Cherry

[57] ABSTRACT

A cargo container handling implement, i.e., a grappler spreader, having the customary four grappling arms for the bottom lifting of piggy-back trailers and four latch units for interlocking with the top latch receptacles of cargo containers, and, in addition, a mechanism by which the latch units are adjustable with respect to the remainder of the grappler spreader in its lateral direction to enable the implement to support a container with the vertical plane of its outwardly offset side beyond the lateral extremities of the adjacent pair of upwardly stored grappling arms.

12 Claims, 15 Drawing Figures

GRAPPLER SPREADER FOR CLOSELY STACKING CARGO CONTAINERS

BACKGROUND OF THE INVENTION

The operation of modern marine and railway terminals normally involves the handling and storage of both cargo containers and piggy-back trailers. Large and expensive mobile carriers are used in combination with various types of implements, commonly called grappler spreaders, to transfer the containers or piggy-back trailers between various types of mobile or stationary platforms. The use of front and side loading carriers is becoming quite common in view of their ability to maneuver loads under a variety of difficult situations. In the case of the steerable rubber tired carrier, it is especially desirable to equip the carrier with a grappler spreader in order to eliminate "down" time required for shifting from container handling to trailer handling and vice versa. Moreover, it is desirable that any type of carrier, including straddle carriers, shall be capable of being equipped with a grappler spreader designed for handling loads in all conceivable positions and surroundings. Especially, it is desired that these carriers, in addition to handling piggy-back trailers, be able to stack and unstack containers stacked in very dense arrangement, e.g., in side-by-side rows several containers high with substantially no spacing therebetween. Normally, closely stacked containers can only be handled by a "top lifting" spreader having no grappling arms. The use of a conventional grappler spreader to handle containers at a level below the top row is impossible because of the protrusion of the grappling arms beyond the top outline of a container.

Thus, an important object of the present invention is to provide grappler spreaders of the type adapted for handling containers and piggy-back trailers under the great variety of conditions in which such carriers are expected to perform without the need for switching from one type of load engaging implement to another.

It is also an object to provide a grappler spreader design which lends itself to a multiple part frame construction of a longitudinally expandable grappler spreader adapted for handling various commercially used lengths of containers and trailers.

A more specific object is to provide a grappler spreader which may penetrate the lower levels of closely stacked containers without damage to containers by protruding grappling arm portions.

Another object of the invention is to provide a grappler spreader design adaptable and general to all types of carrier vehicles.

SUMMARY OF THE INVENTION

The invention resides essentially in a grappler spreader having four grappling arms and four latch units and a main frame providing supporting structure for supporting the grappling arms and the latch units at corners of respective rectangles. For convenience of description, the longitudinal sides of the grappler spreader are referred to as "near" side and "far" side. At least the far side arms and the main frame form pivotal connections with the main frame by which the far side grappling arms may be raised from vertical load gripping positions to horizontal inoperative stored positions along side the upper portion of the main frame above the region occupied by a cargo container latched to the grappler spreader. All four grappling arms are attached to portions of the frame spaced inwardly along the length of the frame from the opposite ends thereof.

The improvement according to this invention is that the far side latch units and the near side latch units are attached to transverse elongate beams at each end of the main frame. Each beam is housed in bearing structure of the main frame with respect to which the beam and the units mounted there on move in unison horizontally transversely with respect to the main frame. In the type of grappler spreader in which only the far side arms are rotatable to horizontally aligned positions, the assemblies comprising each beam means and its associated latch units are movable to operative positions wherein the laterally outward surfaces of the far side latch units are positioned at least slightly outwardly from the laterally outwardmost surfaces of the far side grappling arms.

In one preferred embodiment, all four arms and the main frame define pivotal joints by which the grappling arms may be positioned in upward horizontal alignment alongside an upper portion of the main frame, and the assemblies comprising the beams and respective attached latch units may be moved to either the near side or the far side of the container beyond the lateral extremities of the grappling arms, essentially, the pivotal joints thereof.

In another preferred embodiment, the grappler spreader may be suspended, e.g., by four point suspension comprising cable means connected with each latch unit or adjacent extremities of the beams. Such construction is very advantageous in achieving balance in loading of the portion of the grappler spreader connected with the load and in the suspension of that loaded portion on the supporting crane.

In another preferred embodiment, structure is provided for enabling rotation of each beam as well as longitudinal traverse motion within the bearing portion of the main frame therefor. This latter embodiment provides that the normally damage-capable latches of the latch units may be rotated to a harmless position during operative periods of the grappling arms.

DESCRIPTION OF THE PREFERRED EMBODIMENTS

Figure 1:
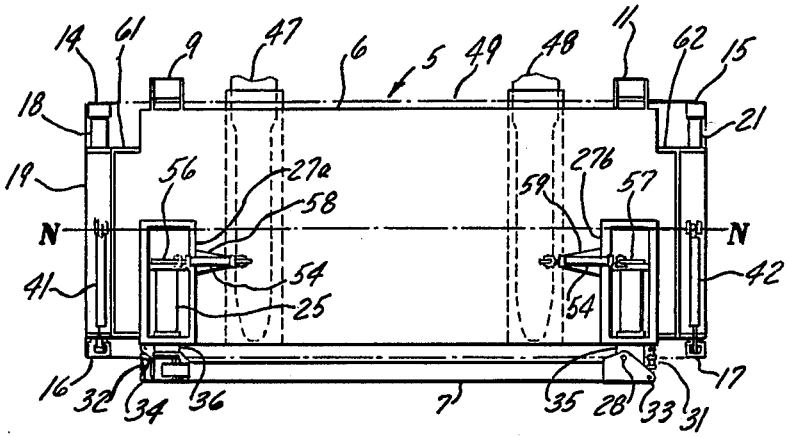
FIG. 1 is a schematic plan view of a grappler spreader in accordance with one embodiment of the invention shown with the container lifting latching units in neutral laterally retracted position.

FIGS. 1, 2, 3 and 7 relate to one form of the invention wherein a grappler spreader 5 comprises a main frame 6, "far side" grappler arms 7,8 swingable to upward storage positions, "near side" downwardly extending grappler arms 9,11 fixed to the main frame 6, near side latch units 14,15, far side latch units 16,17, a beam 18 in telescoping slidable relation with a bearing portion 19 of the main frame for supporting latch units 14,16 in fixed spaced relationship at opposite ends of the beam, and a beam 21 in telescoping slidable relation with a bearing portion 22 of the main frame for supporting units 15, 17 at opposite ends of the beam 21. Bearing portions 19,21 are located longitudinally outwardly along the frame relative to portions of the frame to which grappler arms 7,8,9 and 11 are attached. The figures of the drawing are purposely schematic to eliminate many details of a grappler spreader which are not essential to a description of the invention.

Figure 2:
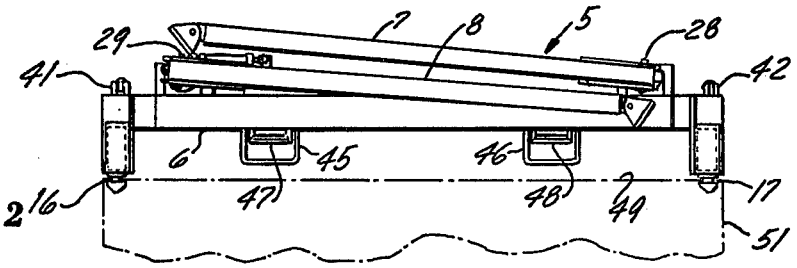
FIG. 2 is a side view of the grappler spreader shown in FIG. 1.
Figure 7:
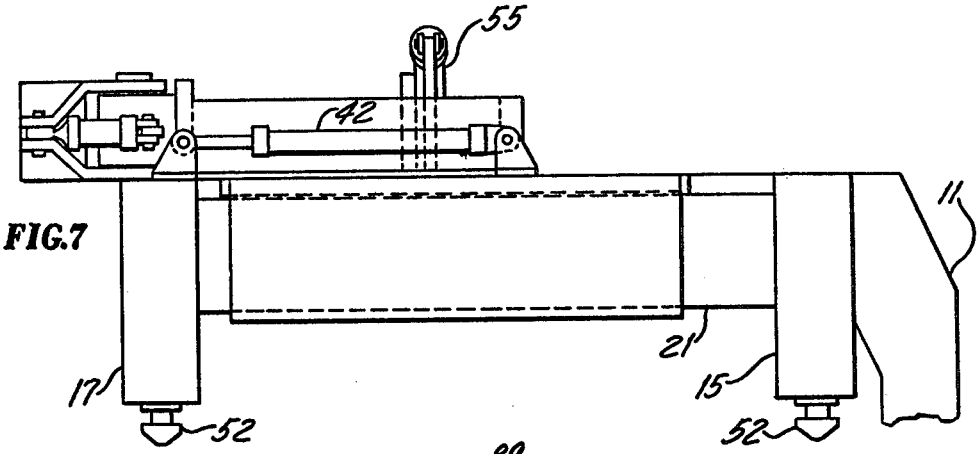
FIG. 7 is a fragmentary end elevation of the grappler spreader shown in FIGS. 1 to 3.
Figure 8:
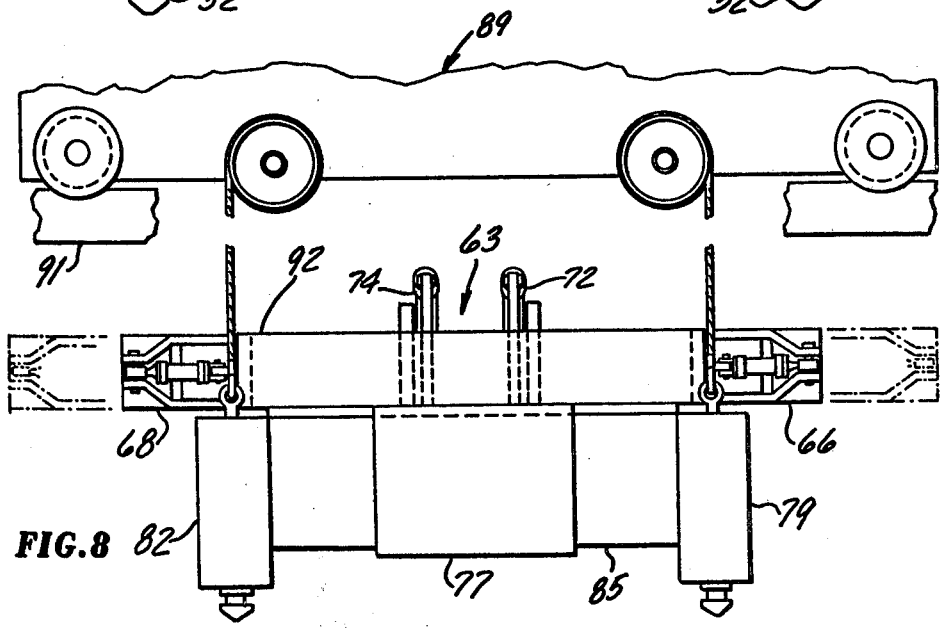
FIG. 8 is an end elevation illustrating the grappler spreader of FIGS. 4 to 6 in combination with a crane and connective cables.

As FIGS. 1, 2, 3 and 7 show grappler arms 7,8 are pivotally attached to trunnions 25,26 respectively, supported in bearing cages 27*a*, 27*b*, fixed to the main frame 6. As shown in FIGS. 2 and 7, the trunnions are mounted in an upper portion of the main frame along axes extending parallel to the transverse direction of the main frame. Rotation of the trunnions and the arms enables the arms to move to the substantially horizontal positions shown in FIG. 2 or in positions typified by the arms of a modified grappler spreader in FIG. 10. The arms are swingable on pivot pins 28,29, respectively, which connect the arms to respective trunnions 25,26 along axes in transverse relation with the axes of rotation of the trunnions. Movement of the arms 7,8 while in a down position toward and away from a load, i.e., toward and away from a vertical plane containing the longitudinal axis N-N of the spreader, is effected by power cylinder assemblies 31,32 which react between the upper arm extensions 33,34, respectively, and radial extensions of the knuckle end portions 35,36 of the trunnions 25,26.

Figure 3:
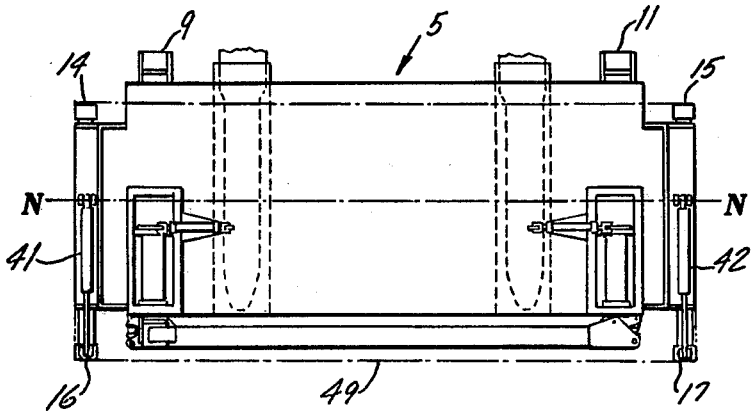
FIG. 3 is a top plan view of the grappler spreader of FIGS. 1 and 2 showing the latching units shifted to a position placing the far side latching units laterally outwardly of the far side grappling arms.
Figure 4:
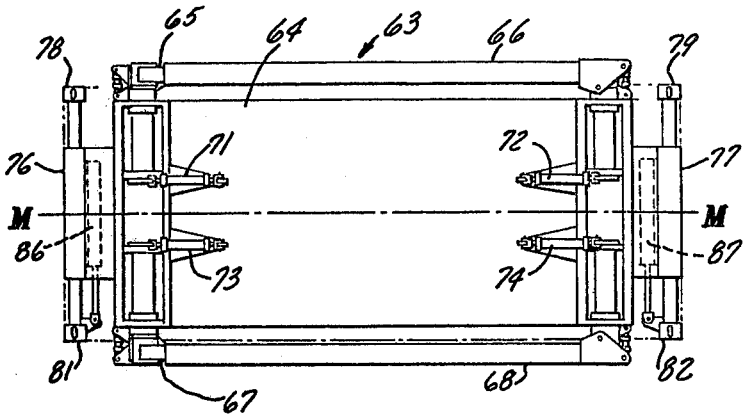
FIG. 4 is a schematic plan view of a grappler spreader modified to enable upward positioning of all four grappling arms and shifting of latching units toward either the near side or the far side.
Figure 5:
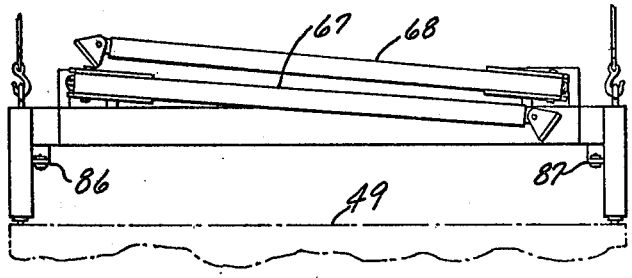
FIG. 5 is a side view of a grappler spreader of FIG. 4.

For handling cargo containers, the aforementioned latch units 14,15, 16, 17 are arranged in a rectangular configuration as viewed in plan which must be necessarily maintained when the position of the latch units is shifted from symmetry with the longitudinal axis N-N in FIG. 1 to the position of FIG. 3 wherein the latch units are shifted as a group toward the far side of the grappler spreader thereby placing units 16,17 in a vertical plane 39 laterally outwardly from the laterally outward sides of upwardly retracted legs 7,8. Such change of position is effected by operation of power cylinder units 41,42 secured at one end to main frame bearing portions 19,22, respectively, and by their other ends to latch units 16,17 respectively. The purpose of this position is to locate a container supported by implement 5 relative to the main frame so that the vertical far side of the container is laterally beyond any portion of the far side grappling arms at upwardly retracted position.

The grappler spreader of FIGS. 1, 2, 3 and 7 comprises transverse channels 45,46 extending transversely along the underside of the main frame 6 spaced to receive fork lift tines 47,48 of a carrying vehicle not shown. The housings of the latch units 14 to 17 necessarily extend to a level exemplified by the rectangular top surface 49 of a container 51 to provide safe clearance between a container top and the channels 45,46. Mechanisms for operating latches 52 which constitute the lower extremity of any of the latch units are well known.

Figure 10:
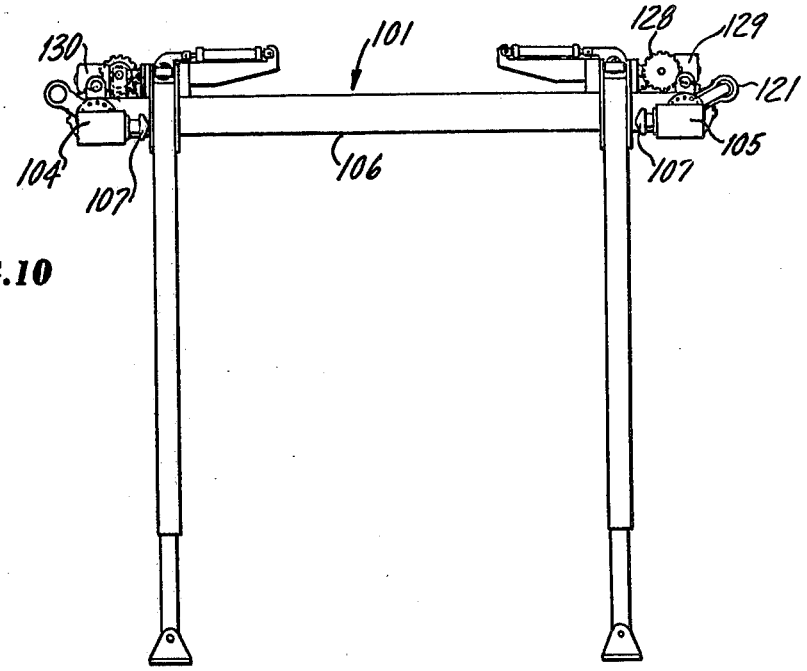
FIG. 10 is a side elevation of the grappler spreader of FIG. 9 illustrating positions of the grappling arms and the latch units adapting it for piggy-back trailer pickup.

For rotating the arms 7 and 8 between the position shown in FIGS. 1, 2 and 3 and exemplified in FIG. 10, power cylinder units 54,55 are connected between radial extensions 56,57 of the trunnion and extensions 58,59 of the bearing cages 27*a*, 27*b*.

In spreaders of the type wherein latch units are positioned laterally beyond the grappling arms of one side only, the main frame may take the shape shown in FIGS. 1 to 3 wherein the main frame bearing portions 19,22 are unsymmetrical with respect to the longitudinal axis N-N. That is to say, the main frame may be laterally indented to a greater extent at 61 and 62 than at the other side of the main frame to allow for a stroke of the beams 18,21 by which the position shown in FIG. 3 is attained.

EMBODIMENT 2

FIGS. 4, 5, 6 and 8 illustrate a grappler spreader 63 having, for purposes of illustration, a main frame 64 of simple design and grappling arms 65,66, 67,68, which are swingable from vertical positions in a manner and by a mechanism similar to that already described with respect to arms 7 and 8 of the first embodiment, by power cylinder units 71,72,73,74 mounted in a manner similar to that of units 54,55 of Embodiment 1. As shown, the main frame including bearing portions 76,77, is constructed symmetrically with respect to a longitudinal axis M—M of the implement.

Figure 6:
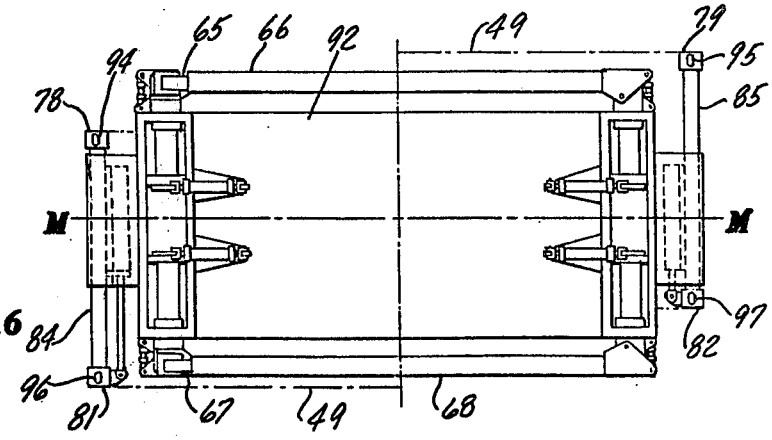
FIG. 6 is a schematic plan view of the grappler spreader of FIGS. 4 and 5 showing the latching units shifted to lateral operative positions.

The essential difference between Embodiment 1 and Embodiment 2 is that latch units 78,79,81,82 may be shifted as a group to positions placing near side units 78,79 laterally outward of the near side arms 65,66 as illustrated by the position 79, in FIG. 6. When units 81,82 are to be positioned at the far side of the grappler spreader outwardly of far side arms 67,68 as typified by the position of unit 81 in FIG. 6, assemblies comprising supporting beams 84,85 and the units attached to each are shifted by power cylinder units 86,87 to the near side or the far side positions as desired. It is, of course, essential when the units are supporting a container that these assemblies be moved in one transverse direction in nearly perfect synchronism by known control mechanisms.

Figure 9:
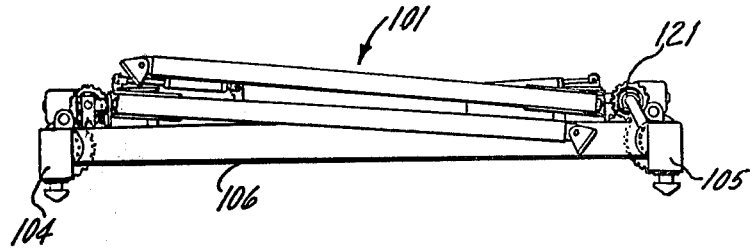
FIG. 9 is a side elevation of another grappler spreader modified to enable both rotation of latching units out of operative position and transverse motion relative to the main frame.

An important feature of the second embodiment is that the load, whether it is a piggy-back trailer or cargo container, may always be supported in balanced symmetrical configuration with crane means such as the overhead crane 89. In FIG. 9 the grappler spreader 63 is shown suspended in four point suspension from the crane 89 movably supported on tracks such as the track 91. It will be noted from FIG. 8 that the two beam and unit assemblies connected by cables to the crane may be regarded as horizontally stationary with regard to the crane while the main frame 92 may be shifted transversely in either direction lengthwise of the beams 85,84. The beam and latch unit assemblies may be attached as shown to the crane cables through the provision of connecting means such as the eye-pieces 94,95,96,97 to the tops of each of the latch units.

EMBODIMENT 3

FIGS. 9, 10, 11, 12 and 13 relate to another modified grappler spreader 101 featuring, in combinations with grappling arms of the upwardly storable type already described, latch units 102,103,104 and 105 which are connected with the main frame 106 by mechanism which affords not only transverse movement of the units but rotative movement as well as to position the latches 107 upwardly with respect to the lowermost under surfaces of the main frame. The latch units are supported on cylindrical beams 108,109 housed within concentric and exteriorly fitting bearing portions 111,112 of the main frame. The beams 108,109 are supported within the bearing portions in both longitudinally and angularly sliding relation therewith. The bearing portions are slotted to receive torsion collars 114,115 in uncircling relation with beams 108,109, respectively. The torsion collars are in longitudinal key and slot relation with the beams 108 and 109.

Figure 11:
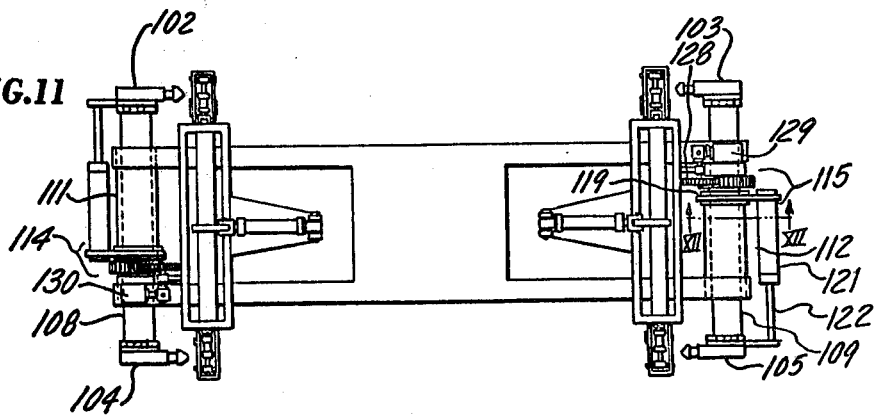
FIG. 11 is a schematic plan view of the grappler spreader of FIGS. 9 and 10 corresponding to the position shown in FIG. 10.
Figure 12:
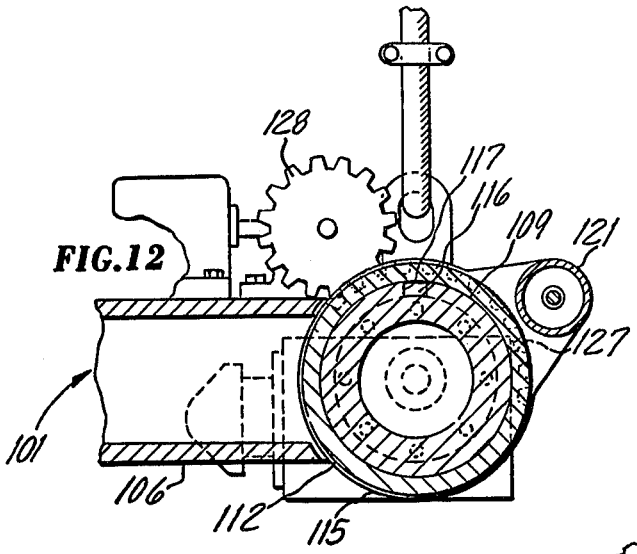
FIG. 12 is a fragmentary section view of the spreader of FIGS. 9 to 11 taken along line XII-XII of FIG. 11.
Figure 13:
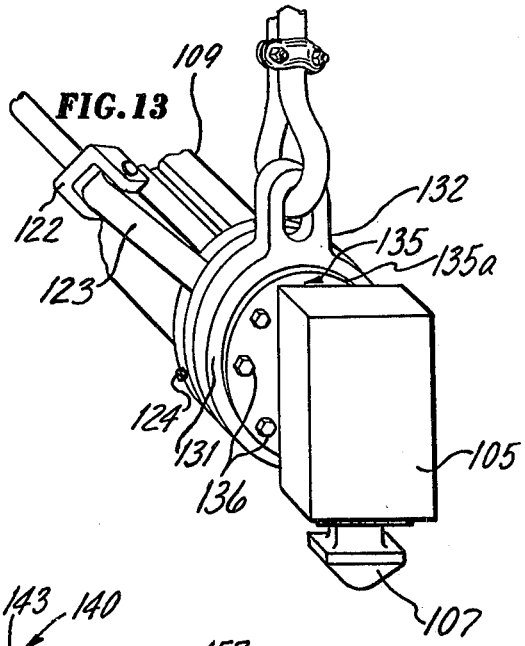
FIG. 13 is a fragmentary perspective view of a beam and latch unit assembly of the grappler spreader of FIGS. 9 to 12.

As shown in FIG. 12, the torsion collar 115 has an integral key 116 which extends into a longitudinal key way 117 of the beam 109. Thus, the beam may undergo axial movement while the collar 115 remains transversely retained by the sides of the slot in the bearing portion 112. The collar 115 also provides a cap 119 for a power cylinder unit 121 of which its piston rod end 122 is pinned to an extension 123 of a ring fixed to the beam 109 adjacent its end by a cap screw 124 or other fastening means. The collar 115 comprises an exterior gear tooth surface 127 in mesh with a gear 128 driven by means such as a motor and gear reduction unit 129. A similar unit 130, as shown in FIG. 11 attached to a portion of the main frame 106, drives a similar system for rotating beam 108. Both beams are subjected by respective power units 129,130 to approximately 90° of rotation between latch operative position as shown in FIG. 9 and retracted positions as shown in FIG. 10 with the positions defined by use of stop switches and mechanical stops of well known design.

Figure 14:
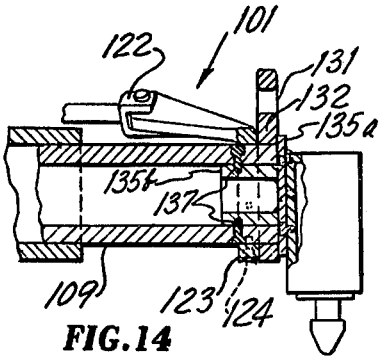
FIG. 14 is a fragmentary view of the apparatus shown in FIG. 13 partly in section along a vertical axial plane with a beam shifting means shown out of normal position.

Grappler spreader 101, when adapted for four point suspension, as in the case of implement 63 of Embodiment 2, comprises a slip ring 131 having an eye portion 132 which surrounds an end portion of the beam 109. Ring 131 is in freely rotatable relation with the end portion to enable the beam to be rotated therewithin when the beam 109 is rotated to change the positions of the latches 107. The slip rings 131 are secured on surfaces at each end of the beams 108,109 by a retainer cap 135 in each case which has an outer plate **135*a* as shown in FIG. 14 of sufficient diameter to radially overlap the side surface of the slip ring 131 and a cylindrical section 135*b* axially overlapping an end portion of the inner surface of the beam 109. The plate 135 is secured to the annular end surface of the beam 109 (also similarly with beam 108) by cap screws 136 and by countersunk cap screws 137 extending radially from the beam 109 into cap section 135*b***.

Figure 15:
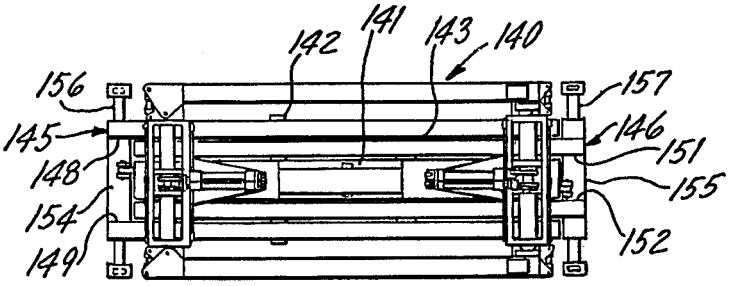
FIG. 15 is a plan view of a longitudinally expandable grappler spreader incorporating transversely adjustable latch-supporting beams.

While the foregoing embodiments have been described with respect to an integral non-extendable main frame the invention is adaptable to expandable grappler spreaders of which FIG. 15 is illustrative. Shown therein is a grappler spreader 140 which has a base section comprising longitudinal member 141 and cross piece such as members 142 and 143. The main frame also consists of cantilever subsections 145 and 146 in longitudinally telescoping relation with the base section which can move into cantilever relation with the base section in extended condition. Section 145 comprises longitudinal pieces 148,149. Section 146 comprises longitudinal pieces 151,152. These various pieces are suitably bearing mounted and supported on the various cross pieces of the main section 141 as disclosed with respect to a spreader frame in Application Ser. No. 525,399, filed Nov. 20, 1974. The main frame comprises a bearing portion 154 as an element of the section 145. Bearing portion 155 is an element of the frame section 146. Latch unit supporting beams 156,157 are transversely traversable of the frame through respectively bearing portions 154,155 forming the outward end portion of sections 145, 146. The grappler spreader 140 may be suspended from a crane, e.g., in the manner described with respect to the grappler spreader 63 of FIGS. 4, 5 and 6, by attachment of the base section of device 140 to a fork lift carrier in the manner grappler spreader 5 of FIGS. 1, 2 and 3, or by cable suspension of the device 140 through its base section.

What is claimed is:

1. A grappler spreader comprising:

a main frame normally having its transverse and longitudinal directions in a horizontal plane and its longitudinal sides consisting of a near side and a far side;

four grappling arms comprising a near side pair and a far side pair attached to portions of said frame spaced inwardly lengthwise thereof from opposite ends of the frame adapting the arms for assuming a vertical position during use, each of the far side pair of arms forming a pivotal joint with the frame extending in laterally outwardly projecting relation with the adjacent far side of said frame;

the far side arms being swingable on said pivotal joints from vertical to approximately horizontal storage positions disposing said arms at a level at the approximate height of said pivotal joints;

four latch units arranged at the corners of a horizontal rectangle and terminating below said main frame and said far side arms in said storage positions as latches adapting the grappler spreader for connection with latch receptacles in the upper four corners of a container, said units being arranged in two pairs of which each pair is located at one of the opposite ends of the grappler spreader;

separate transverse beam means supported at each end of the frame, each beam means supporting a pair of said units consisting of a near side unit and a far side unit mounted on opposite ends of the beam means in fixed spaced relationship;

bearing means located at opposite ends of the main frame longitudinally outwardly along said frame relative to said portions of the frame to which said arms are attached arranged for receiving and supporting each of said beam means at its respective end of the frame in horizontally and transversely guided relation therewith, each of said beam means and the bearing means associated therewith being constructed and arranged to afford movement of each beam means and the units mounted thereon in unison in one direction between positions of both beam means wherein said far side units are located laterally inwardly relative to said swingable arms and positions wherein said far side units are located at least partly laterally outwardly relative to said swingable arms.

2. The grappler spreader of claim 1 comprising:

channel means adapted to receive tines of a fork lift vehicle extending transversely of the main frame in fixed relation thereto along its underside;

said latch units extending downwardly to a level lower than under surfaces of said channel means.

3. The grappler spreader of claim 2 wherein:

said near side arms are fixed to the main frame.

4. The grappler spreader of claim 1 wherein:

said main frame comprises longitudinal beams and channels of box cross section, said channels extending in their longitudinal direction transversely of said longitudinal beams in fixed relation with the underside of said beams;

said latch units extending to a level lower than the under surfaces of said channels.

5. The grappler spreader of claim 1 comprising:

separate power means connecting with, and reacting between, the main frame and each of two assemblies, each assembly comprising one of said beam means and the latch units attached thereto, said power means being operable to effect changes of position of both of said assemblies transversely relative to the main frame.

6. The grappler spreader of claim 1 wherein:

each near side arm forms a pivotal joint with the frame extending in laterally outwardly projecting relation with said near side of the main frame;

the length of said bearing means at both ends of the main frame being symmetrical with respect to the longitudinal axis of the main frame and of a length with respect to portions of the beam means slidable therethrough to afford movement of said beam means between positions wherein said far side units are located at least partly laterally outwardly relative to the far side swingable arms, and positions of the near side units wherein the near side units are located at least partly laterally outwardly relative to said near side swingable arms.

7. The grappler spreader of claim 6 comprising:

connecting means on opposite end portions of each assembly comprising one of said beam means and the latch units attached thereto adapting the grappler spreader for four point pendant attachment to a crane.

8. The grappler spreader of claim 7 wherein:

each of said beam means is rotatable within said bearing means through an angle effecting rotation of said latch units to positions swinging said latches upwardly out of a plane of engagement of any undersurfaces of the grappler spreader with an upward-facing plane surface extending under all of said latch units.

9. The grappler spreader of claim 8 comprising:

crane-connecting means adjacent each end of each assembly connected to a portion thereof in angularly adjustable relation therewith about an axis of rotation extending lengthwise of the beam means.

10. The grappler spreader of claim 8 comprising:

collar means surrounding each beam means in longitudinally slidable tongue and groove relation therewith;

retaining means associated with the main frame restricting axial movement of each of the collar means;

first power means connected with the main frame and the collar means for rotating the collar means; and second power means connected with said collar means and an end portion of the assembly, the beam means of the assembly extending slidably through said collar means.

11. The grappler spreader of claim 1 wherein:

each of said beam means is rotatable within said bearing means through an angle effecting rotation of said latch units to positions swinging said latches upwardly out of a plane of engagement of any undersurfaces of the grappler spreader with an upward-facing plane surface extending under all of said latch units.

12. A longitudinally expandable grappler spreader according to claim 1 wherein said main frame comprises a base section and two cantilever sections in telescoping relation with said base section, said cantilever sections having said bearing means at the outward end portions.

* * * * *